US007753621B2

(12) United States Patent
Steffen

(10) Patent No.: US 7,753,621 B2
(45) Date of Patent: Jul. 13, 2010

(54) VIBRATING PLATE COMPRISING A REMOTE CONTROL THAT IS INTEGRATED INTO A DRAW BAR

(75) Inventor: Michael Steffen, Munich (DE)

(73) Assignee: Wacker Neuson SE, Munich (DE)

( * ) Notice: Subject to any disclaimer, the term of this patent is extended or adjusted under 35 U.S.C. 154(b) by 477 days.

(21) Appl. No.: 11/576,740

(22) PCT Filed: Sep. 30, 2005

(86) PCT No.: PCT/EP2005/010593

§ 371 (c)(1),
(2), (4) Date: Jan. 11, 2008

(87) PCT Pub. No.: WO2006/037568

PCT Pub. Date: Apr. 13, 2006

(65) Prior Publication Data

US 2008/0247824 A1 Oct. 9, 2008

(30) Foreign Application Priority Data

Oct. 5, 2004 (DE) ..... 10 2004 048 459

(51) Int. Cl.
*E01C 19/40* (2006.01)
*E01C 19/32* (2006.01)

(52) U.S. Cl. ..... 404/133.1; 404/102

(58) Field of Classification Search ..... None
See application file for complete search history.

(56) References Cited

U.S. PATENT DOCUMENTS 4,823,366 A * 4/1989 Williams ..... 377/2
4,896,995 A * 1/1990 Simmons ..... 404/90
6,435,767 B1 * 8/2002 Steffen ..... 404/133.1
6,582,154 B1 * 6/2003 Updyke et al. ..... 404/118
6,997,648 B2 * 2/2006 Steffen ..... 405/271
7,232,277 B2 * 6/2007 Corbitt ..... 404/112
7,549,821 B2 * 6/2009 Hall et al. ..... 404/75
2004/0022582 A1 2/2004 Sick

FOREIGN PATENT DOCUMENTS

DE 29804047 U1 6/1998
DE 19913074 A1 10/2000
DE 10226920 A1 1/2004

* cited by examiner

*Primary Examiner*—Raymond Addie
(74) *Attorney, Agent, or Firm*—Boyle Fredrickson S.C.

(57) ABSTRACT

The invention relates to a vibrating plate for ground compaction, said plate comprising a remote control device for controlling at least one forward or rear journey by the excitation of an oscillation device. The remote control device comprises an emitter unit, which can be displaced independently of the remaining vibrating plate and which can be detachably fixed to a draw bar. In a remote control mode, the emitter unit is held by the user and displaced independently of the vibration plate. In a draw bar mode, the emitter unit is placed on one end of the draw bar, so that the user can guide the vibrating plate by the pulling and pushing of robust control handles on the emitter unit. The latter can have at least one control handle, which can be used not only to input control commands for controlling the oscillation device, but can also be held by the user to manually guide the vibrating plate.

19 Claims, 4 Drawing Sheets

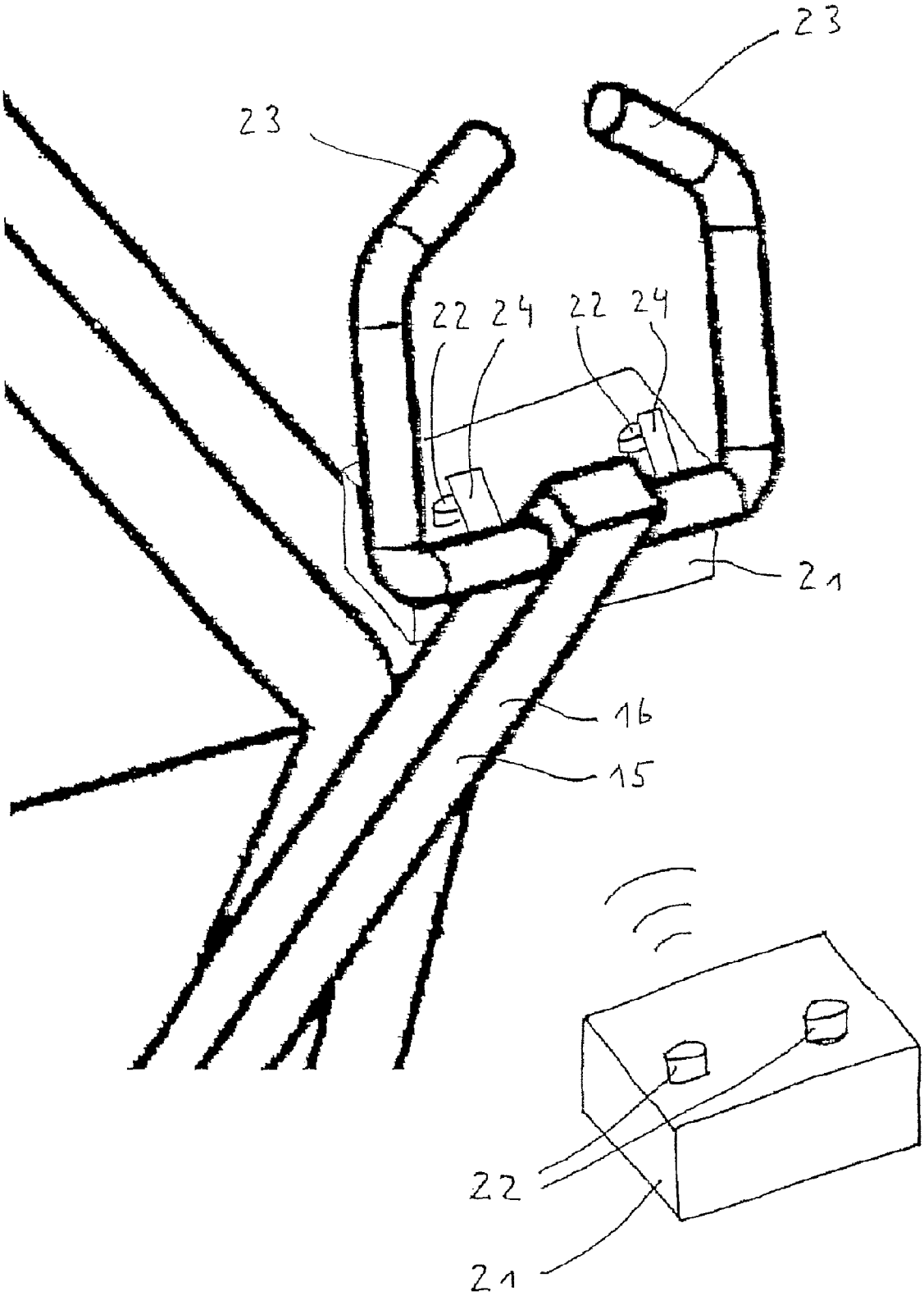
FIG..4

VIBRATING PLATE COMPRISING A REMOTE CONTROL THAT IS INTEGRATED INTO A DRAW BAR

BACKGROUND OF THE INVENTION

1. Field of the Invention

The present invention relates to vibrating plates according to the preambles of patent claims 1 and 3.

2. Description of the Related Art

Vibrating plates for soil compaction are known in many embodiments. Such vibrating plates have in common that they are made tip in principle of a lower mass and an upper mass that is decoupled in terms of vibration from the lower mass via a spring device. The lower mass has a soil contact plate that acts on the soil and a vibration exciter device fastened thereon. An essential component of the upper mass is a drive motor that drives the vibration exciter device on the lower mass in a suitable manner (mechanically, hydraulically). Known one- and two-shaft exciters are examples of suitable vibration exciters.

FIG. 1 shows a perspective view of a vibrating plate having a drawbar control device, known from DE 102 26 920 A1.

On a soil contact plate 1, a vibration exciter 2 is attached that is driven by a drive 3, e.g. an internal combustion engine. Soil contact plate 1 and vibration exciter 2 form a lower mass, while drive 3, together with a frame 4 and a cover 5, are considered to be part of an upper mass. The upper mass is vibrationally decoupled from the lower mass with the aid of intermediately connected spring devices (not shown in FIG. 1).

Cover 5 of the upper mass has attached to it a drawbar 6 that has a drawbar boom 7 that ends in a drawbar head 8 (shown only schematically). Two control handles 9 are mounted pivotably on drawbar head 8. With the aid of control handles 9, hydraulic valves can be controlled via which the phase position of rotating imbalance masses or imbalance shafts in vibration exciter 2 can be altered. In this way, the direction of a resultant force vector produced by the imbalance masses in vibration exciter 2 can be adjusted in a known manner in order to achieve forward and backward travel of the vibrating plate.

In addition, control handles 9 are constructed with enough mass that the operator can draw and pull on them in such a way as to alter the direction of the vibrating plate during operation.

A travel mechanism 10 is used only for transporting the vibrating plate, and does not have any function during operation.

In large, steerable vibrating plates, it is possible for at least one of the imbalance shafts to be axially divided in order to control different imbalance masses in such a way as to produce a yaw moment about a vertical axis of the vibrating plate, in order to enable steering of the plate. In smaller, lighter vibrating plates, usually a drawbar is provided with which the operator can guide the vibrating plate. Here, the vibration exciter produces not only the vibrations that compact the soil, but also a force component in the forward or backward direction. Correspondingly, handles are provided on the drawbar via which the operator can control the vibration exciter device in the desired manner in order to achieve the desired direction of travel. The steering and guiding of the vibrating plate is accomplished by the operator by moving the end of the drawbar with the aid of the control handles or additional handles.

Above all in large, heavy vibrating plates, it has become standard to provide a remote control with the aid of which the operator can control the vibrating plate without being located in its immediate vicinity. This is useful above all because heavy vibrating plates introduce very strong vibrations into the soil that can have a harmful effect on people standing directly adjacent to the plate. In addition, the danger to the operator as a result of contact with the moving vibrating plate is less, due to the greater distance.

However, in practice it has turned out that the vibrating plates execute a wobbling, random movement due to the strong vibrations and accidental counterforces that sometimes occur due to the soil being compacted. Thus, it is often difficult to guide the vibrating plate precisely in a straight line over a longer path. Likewise, in practice it requires a very high degree of concentration on the part of the operator if the vibrating plate is to be guided along a curve. Correspondingly, the operator constantly has to carry out steering corrections, which often do not achieve the desired result due to the very indirect effect of the operator's control commands. Differing from, for example, vibrating rollers, the operator of a vibrating plate cannot exert an immediate influence on the forward drive or a corresponding steering device. Rather, the operator can only influence the position of the imbalance masses in the vibration exciter, in the hope that this will result in corresponding centrifugal forces that draw the vibrating plate in the desired direction.

Thus, the remote control offers the operator only a very limited degree of sensitivity. In particular in cases in which the soil compacting requires a high degree of precision, for example along a curb wall, the operator will attempt to guide the vibrating plate manually using the drawbar. However, remote-controllable vibrating plates have in most cases no guiding drawbar, or one having only a rudimentary construction, often having a short handle that makes it difficult to guide the vibrating plate manually.

One solution to this problem could be to provide a hybrid control device in which a vibrating plate is equipped with a drawbar controlling in the classical manner, in which the operator can manually guide the drawbar using control handles and can control the vibration exciter via the control handles. In addition, a known remote control is provided that is used if the operator does not wish to guide the drawbar. A disadvantage of this hybrid controlling is that it requires a very high constructive expense, because on the one hand two sets of command devices must be present (control handles on the drawbar end and control elements at a transmitter of the remote control). In addition, the transmitter is a separate part of the control device that has to be housed on the vibrating plate when it is not being used, so that it will not be lost.

In a vibrating plate manufactured by applicant, having the type designation "Wacker DPU 7060," instead of a drawbar a guide bow is fastened to the upper mass of the vibrating plate. Instead of operating elements, the guide bow has a holder in which the transmit unit of a cable-connected remote control can be used. The controlling of the vibration exciter takes place exclusively via the operating elements of the cable-connected remote control.

From DE 199 13 074 A1, a soil compacting device is known in which at the end of a drawbar an operating element is attached that is capable of being moved relative to the drawbar. The respective position of the operating element is acquired by a sensor device that forwards a corresponding signal to a hydraulic control unit for a vibration exciter.

In US 2004/0022582 A1, a vibrating plate having a radio remote control device is indicated. A joystick for inputting control commands is provided on the transmit unit of the remote control device.

OBJECT OF THE INVENTION

The present invention is based on the object of indicating a vibrating plate that is equally easy to manipulate for the operator both in remote control operation and also when manually guided in drawbar operation, such that the manufacturing costs are not noticeably higher compared to known vibrating plates.

This object is achieved according to the present invention by vibrating plates as recited in claims 1 and 3. Advantageous developments of the present invention are defined in the dependent claims.

According to the present invention, a vibrating plate standardly comprising a lower mass and an upper mass has a drawbar device that is connected to the upper mass and/or to the lower mass. In addition, a remote control device is provided for controlling at least a forward or backward travel by controlling the vibration exciter device of the lower mass, said remote control device having a transmit unit that is capable of being moved independently of the rest of the vibrating plate. The transmit unit is capable of being detachably fastened to the drawbar device. On the transmit unit, at least one control handle is provided that can be used optionally for operator inputs of control commands in order to control the vibration exciter device, and/or that can be grasped by the operator in order to manually guide the vibrating plate.

Correspondingly, the transmit unit can be detached from the drawbar device if the operator desires remote control operation. If, in contrast, precise compacting work requires manual guiding of the vibrating plate, the transmit unit can be fastened to the drawbar device. The operator then guides the vibrating plate exclusively via the control handles present on the control unit. For this purpose, the operator can either actuate the control handles so as to generate control commands with which the vibration exciter device can be adjusted in the desired manner, or can pull and push the control handles in order to manually influence the direction of travel of the vibrating plate using bodily force.

In the present context, the term "drawbar device" stands for a drawbar in which a drawbar boom is connected to the vibrating plate at an articulation point, or for a guide bow that as a rule is held on the vibrating plate at two articulation points. Thus, strictly speaking, a guide bow is different from a drawbar. If, nonetheless, hereinafter only the term "drawbar" is used for simplification, it is intended also to include reference to a guide bow having two articulation points.

Advantageously, on the transmit unit at least one additional control element can be provided for the inputting of control commands by the operator in order to control the vibration exciter device. This corresponds to the classical design of a transmit unit.

In order to distinguish the terms, it is stipulated by definition that hereinafter a "handle" is used only for the mechanical guiding of the vibrating plate, while a "control element" is used exclusively for inputting control commands for the vibration exciter, the drive, or the like. Due to its dimensions and strength, a control element is not suitable for accepting larger guiding forces. If the operator were to attempt to mechanically guide the vibrating plate using a control element, damage to the control element would be expected.

The term "control handle" is delimited from the terms "control element" and "handle" as follows: the control handle is suitable on the one hand for controlling the vibrating plate through the production of corresponding control signals and adjustment of the vibration exciter. On the other hand, the control handle is realized mechanically so as to be stable enough that the operator can pull and push this handle in order to guide the vibrating plate, as is the case with an operating lever of a classical drawbar guiding device.

In the present context, "guiding" is to be understood to mean the mechanical action of the operator through pulling or pushing. In contrast, "controlling" refers to the production of control signals for the vibration exciter and the drive, which then produce forces that move the vibrating plate forward or backward, or for steering about a vertical axis (yaw axis).

In the solution according to claim 1, it is possible that the drawbar need not be provided with any handle or control element at all. Rather, all the operating elements are provided exclusively by the transmit unit. In remote control operation, the control handle is used to produce corresponding control signals. In drawbar operation, with the transmit unit situated on the drawbar boom, the control handle can also produce control commands. In addition, however, the operator can also make corrective interventions manually, and can in particular steer the vibrating plate using lateral forces.

In the variant indicated in claim 3, a control element is provided on the transmit unit for the input of control commands by the operator, while the drawbar device bears at least one control handle to be grasped by the operator for manual guiding of the vibrating plate.

In addition, the control handle should be movable relative to the drawbar device. If the transmit unit is fastened to the drawbar device, the control handle is coupled to the control element of the transmit unit in such a way that given a particular relative position of the control handle an actuation of the control element of the transmit unit is effected in order to produce control commands for controlling the vibration exciter device.

In this specific embodiment of the present invention, the operator has the possibility of operating the vibrating plate in a conventional manner by remote control, with the aid of the control elements present on the transmit unit. Alternatively, the operator can place the transmit unit on the drawbar device. On the drawbar device, stationary control handles are provided whose design can correspond to the control handles described above with reference to FIG. 1. With the aid of e.g. an entraining device, the movement of a control handle is transmitted to its allocated control element of the transmit unit. In this way, in drawbar operation the operator has the possibility of actuating the robust control handle, familiar to him, in a known manner. However, while in the prior art for example hydraulic valves are controlled in this way in order to control the vibration exciter, now the movement of the control handle, or its relative position, is used to actuate the allocated control element of the transmit unit. This in turn then effects, in a conventional manner, the controlling of the vibration exciter. The system thus simulates a classical drawbar controlling. In addition, the control handle itself also acts as a handle, because it is constructed robustly enough to be pushed and pulled by the operator.

Because in the end there is therefore only one possibility for controlling, namely via the transmit unit of the remote control that is also used by the control handle of the drawbar, significant manufacturing costs can be saved.

In a particularly advantageous specific embodiment of the present invention, the control handle is held in a holder on the drawbar device in order to receive forces introduced into the control handle by the operator. The holder should be constructed in such a way that only a small part, for example the part required for the actuation of the allocated control element, of the forces introduced by the operator actually act on the control element and/or on the transmit unit, while the other, generally larger, part of the forces is transmitted by the control handle directly to the drawbar, without acting on the control element and/or the transmit unit. If, in contrast, the entire force applied by the operator were able to act on the control element or on the transmit unit, the danger would arise that these comparatively weakly dimensioned components would be destroyed. The holder ensures that even large forces exerted by the operator are introduced into the drawbar as immediately as possible, while only an alteration of the relative position (change of path) of the control handle is transferred to the transmit unit and thus to the control element provided thereon.

Preferably, the transmit unit can be integrated into the drawbar in detachable fashion, in order to protect it from damaging external influences when it is not in use.

In a particularly advantageous specific embodiment, the drawbar has a drawbar boom that is connected to the upper mass and/or to the lower mass, and a drawbar head that is connected to the drawbar boom. Here, it is particularly advantageous if the transmit unit is capable of being fastened in a recess in the drawbar head, or forms a part of the drawbar head, or even the entire drawbar head. This means that at first only the drawbar boom is a component of the vibrating plate when the vibrating plate is operated in remote control operation, and correspondingly the transmit unit is removed from the vibrating plate. If, in contrast, the operator fastens the transmit unit on the drawbar boom, the transmit unit takes over the essential functions of a classical drawbar head. In particular, the transmit unit is then suitable for receiving forces applied by the operator for guiding the vibrating plate, and mechanically transmitting them to the rest of the vibrating plate via the drawbar boom, so that the operator can manually guide the vibrating plate in a very sensitive manner without having to exercise the actual remote control functions of the transmit unit.

In addition, it can be advantageous if at least one handle is provided on the drawbar that can be grasped by the user for the manual guiding of the vibrating plate. This design is also known in vibrating plates that have a classical drawbar controlling. However, the present invention makes it possible for e.g. the transmit unit that forms the drawbar head to take over the sole controlling of the vibration exciter, with the aid of the control element or elements, while mechanical guide forces of the operator are transmitted to the drawbar solely via the handle, even when the transmit unit is placed on the drawbar.

The various operating elements control element, control handle, and handle can be arbitrarily selected and combined depending on the specific embodiment of the present invention. It is decisive that on the one hand it is possible to control the vibrating plate in remote control operation and on the other hand the options "control" and "guide" are possible in drawbar operation. Correspondingly, the transmit unit must be equipped with at least one control element or control handle. To the extent that the transmit unit has only control elements, suitable control handles, but preferably handles, must also be provided on the drawbar in order to enable mechanical guiding. If the transmit unit has a control handle, however, no additional handles need be provided on the drawbar.

In a particularly advantageous specific embodiment of the present invention, the vibration exciter device is fashioned such that it produces a yaw moment about a vertical axis of the vibrating plate in order to steer the vibrating plate. Such a design is known from high-performance remote-controllable vibrating plates.

According to the present invention, it is particularly advantageous that this vibration exciter device can be controlled by the transmit unit in order to adjust the yaw moment when the transmit unit is separated from the rest of the vibrating plate. If, however, the transmit unit is fastened to the drawbar, no yaw moment should be producible by the vibration exciter device. This is because in this case the steering of the vibrating plate is taken over exclusively by the operator, who manually guides the vibrating plate at the drawbar or transmit unit.

Preferably, in the remote control device a control command for steering the vibrating plate can be blocked when the transmit unit is fastened on the drawbar. In this way, the specific embodiment described above, in which in drawbar operation no yaw moment is to be produced by the vibration exciter device, can be realized very easily.

In a preferred specific embodiment, on the drawbar a fastening device is provided for fastening the transmit unit on the drawbar in such a way that all forces exerted on the transmit unit by the operator can be mechanically transmitted to the drawbar. While in previously known vibrating plates a recess or compartment was provided for housing the transmit unit, here the transmit unit is able to enter into a stable mechanical connection to the drawbar. The transmit unit is then able to transmit the forces exerted on it by the operator to the drawbar without being damaged. In this way, the transmit unit can also act as a drawbar head.

In addition, it can be advantageous if an electrical charge device is provided with which an energy storage unit in the transmit unit, e.g. an accumulator, can be charged through a supply of current from the vibrating plate when the transmit unit is fastened on the drawbar. Correspondingly, the transmit unit can be charged by the vibrating plate whenever remote control operation is not required. This would mean that the transmit unit would not constantly have to be recharged while separated from the vibrating plate.

Advantageously, in remote control operation when the transmit unit is separated from the vibrating plate, the signals are capable of being transmitted by the transmit unit via a cable path, an infrared path, and/or a radio path to a receive unit provided on the vibrating plate.

If, in contrast, the transmit unit is fastened to the drawbar, it is advantageous to transmit the signals from the transmit unit via a direct coupling, an optical interface, or an infrared interface to the receive unit provided on the vibrating plate. The direct coupling can for example be fashioned as a plug contact, so that the transmit unit can be fastened to the drawbar in the manner of a docking station. Likewise, it is also possible to transmit the signals by radio (e.g. Bluetooth) if the transmit unit is fastened on the drawbar.

In a particularly advantageous development, the drawbar is capable of being pivoted between an operating position in which the operator, e.g. in drawbar operation, exerts guiding forces on the vibrating plate via the drawbar boom, and a remote control position in which the operator controls the vibrating plate only via the transmit unit separate from the vibrating plate. In addition, or alternatively, the length of the drawbar boom can also be altered between the operating position and the remote control position. This makes it possible for the operator to make the drawbar boom smaller in particular if a longer period of exclusively remote control operation is desired. The drawbar boom then does not pose an obstacle during operation. However, if the operator wishes to work in drawbar operation, it is helpful for the drawbar boom, with transmit unit placed thereon, to be extended to an ergonomically suitable height. In addition, a suitable length for the drawbar boom in drawbar operation is to be sought, so that the operator does not have to apply excessively large guiding forces due to the lever effect.

These and additional features of the present invention are explained in relation to an example with the assistance of the Figures.

BRIEF DESCRIPTION OF THE DRAWINGS

FIG. 4 shows a detail of another specific embodiment of the vibrating plate according to the present invention.

DETAILED DESCRIPTION OF THE PREFERRED EMBODIMENT

Figure 1:
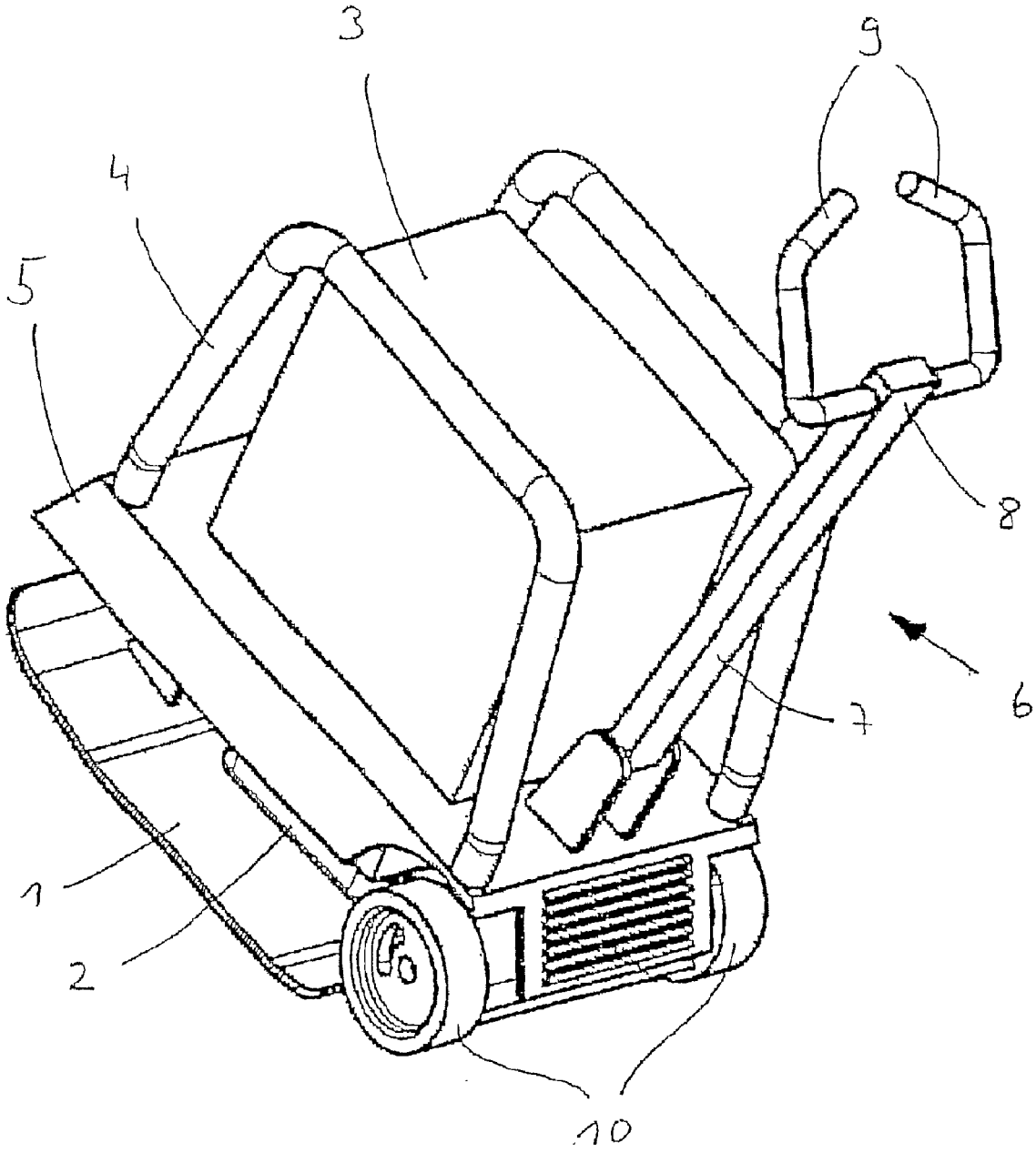
FIG. 1 shows a schematic perspective view of a vibrating plate known from the prior art having a drawbar controlling.
Figure 2:
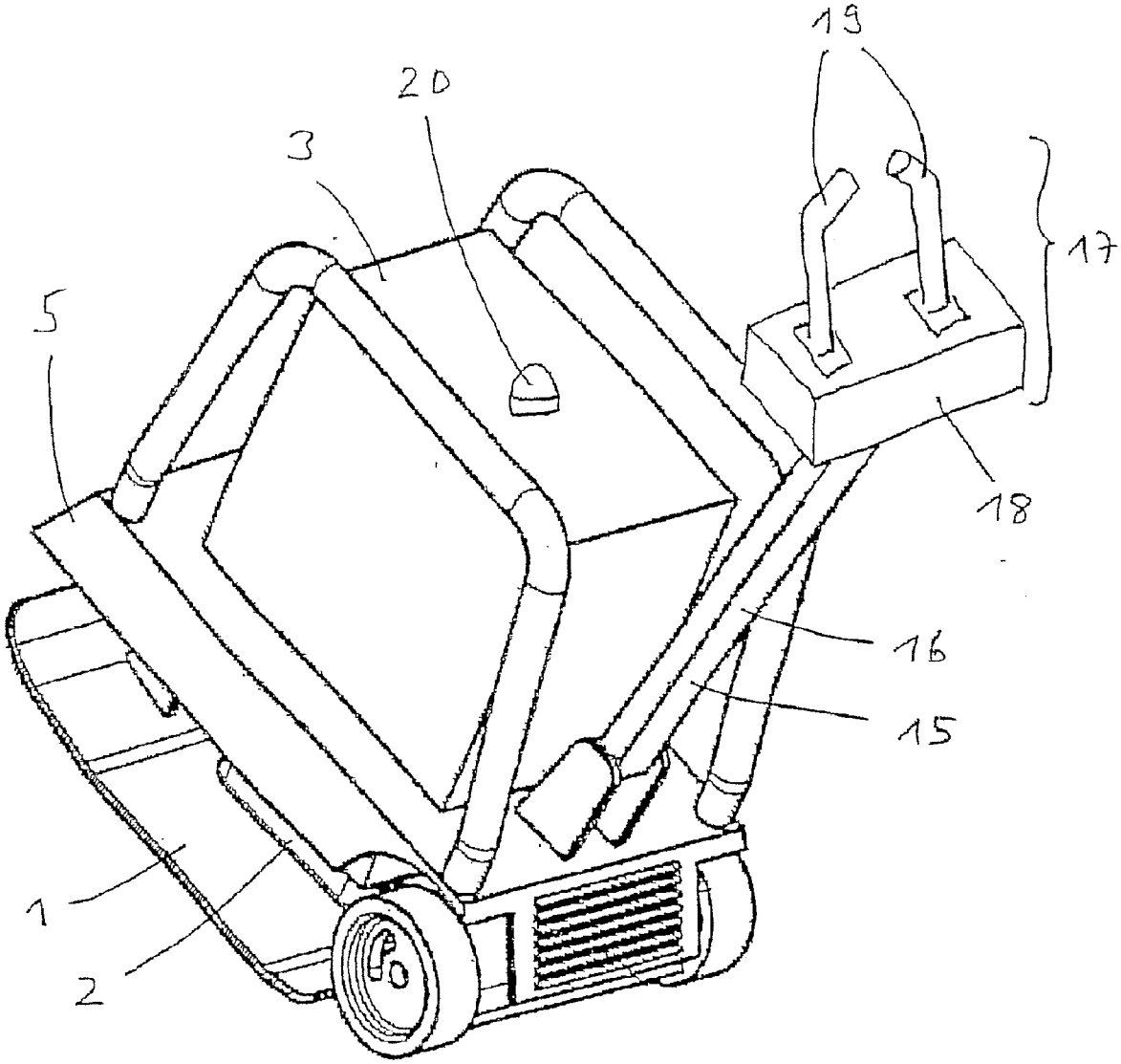
FIG. 2 shows a schematic perspective view of a vibrating plate according to the present invention in drawbar operation.
Figure 3:
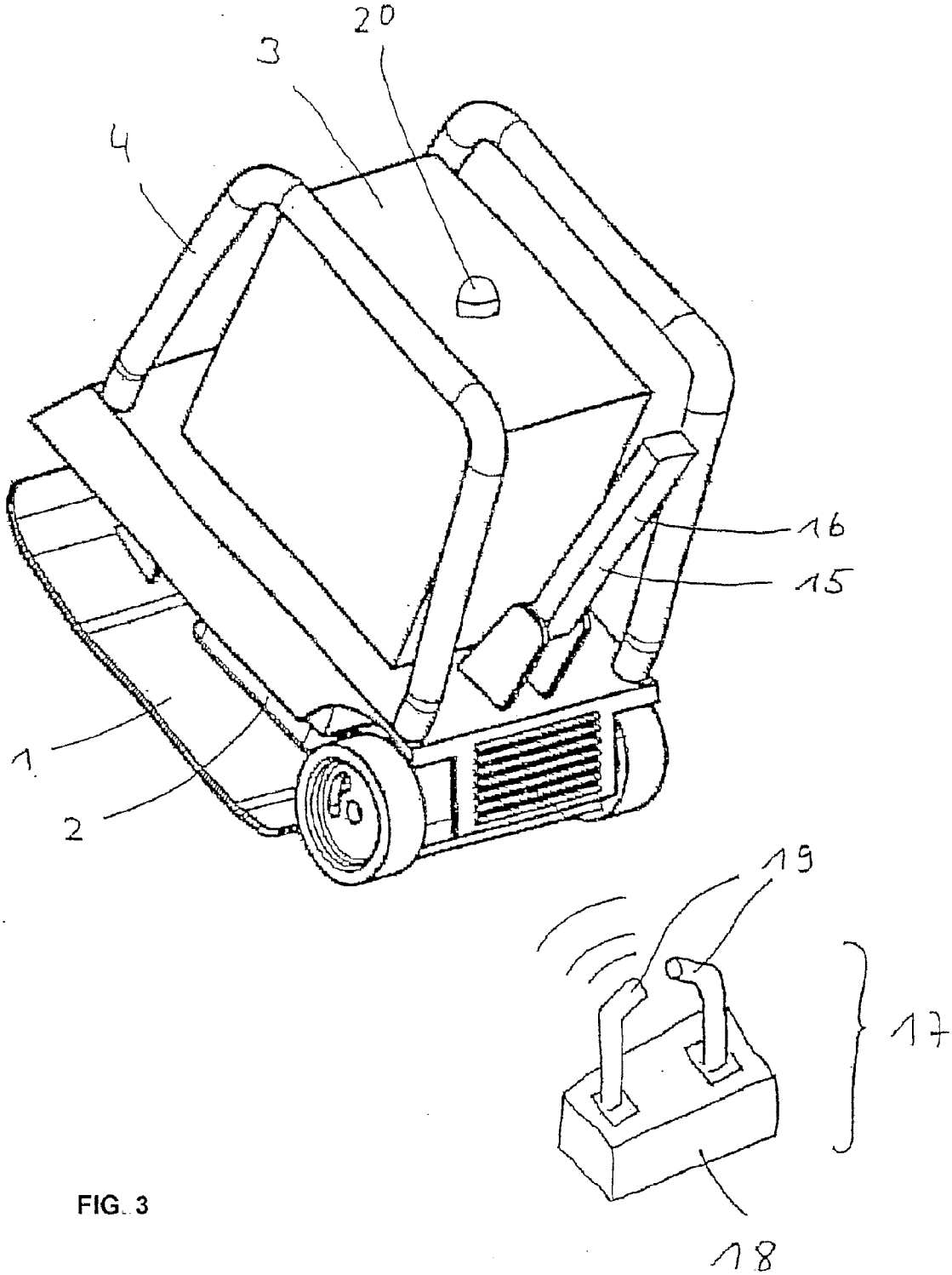
FIG. 3 shows the vibrating plate of FIG. 2 in remote control operation.

FIGS. 2 to 4 each show a vibrating plate for soil compacting according to the present invention, each having a design largely identical to the vibrating plate known from the prior art and already described above on the basis of FIG. 1. Thus, identical reference characters are used for identical components. In the vibrating plate according to the present invention shown in FIGS. 2 to 4, the situation of the lower mass, made up of a soil contact plate 1 and a vibration exciter 2, and of the upper mass, having a drive 3, a frame 4, and a cover 5, as well as of the spring device situated between the upper mass and the lower mass for the vibrational decoupling of the upper mass from the lower mass, correspond to the construction of the vibrating plate known from the prior art as shown in FIG. 1. Therefore, reference is made to the description above relating to FIG. 1, in order to avoid repetition.

According to FIG. 2, a drawbar 15 is attached to the upper mass, namely to cover 5. Drawbar 15 has an essentially bar-shaped drawbar boom 16, to the end of which a transmit unit 17 is detachably fastened. Transmit unit 17 therefore forms a drawbar head of drawbar 15.

Instead of drawbar 15, a guide bow can also be provided, connected to the upper mass at two articulation points instead of one. The following description of a vibrating plate according to the present invention having a drawbar can therefore also apply immediately to a vibrating plate having a guide bow. Thus, the present invention also relates to vibrating plates equipped with a guide bow on which a transmit unit is detachably fastened. The guide bow and the drawbar thus differ from one another only in the number of points at which they are fastened to the upper mass.

As is shown in FIG. 3, transmit unit 17 can be detached from drawbar boom 16, and can thus be moved separately from the rest of the vibrating plate. If transmit unit 17 is removed from drawbar boom 16 (FIG. 3), it enables the vibrating plate to be controlled in remote control operation. If, in contrast, transmit unit 17 is placed on drawbar boom 16, the controlling of the vibrating plate takes place in drawbar operation.

Transmit unit 17 has a housing 18 that bears one or more control handles 19. Control handles 19 can be actuated by the operator and are used to specify control commands that are finally communicated to vibration exciter 2 or to drive 3, where they bring about corresponding known control measures for controlling the vibrating plate.

Control handles 19 can for example be levers whose pivot or relative position relative to housing 18 can be altered. Via suitable sensors (Hall sensors, potentiometers, etc.), the relative positions or changes in position are acquired and converted into electrical signals. Of course, other operating elements, such as keys, switches, sliders, etc., can also be fastened to housing 18 of transmit unit 17.

If, during remote control operation according to FIG. 3, transmit unit 17 is separated from the rest of the vibrating plate, the specified control signals are transmitted wirelessly via an infrared or radio path, or non-wirelessly via a connecting cable, to a receiver (not depicted) that is generally provided on the upper mass of the vibrating plate; said receiver converts the signals into corresponding control signals for vibration exciter 2 or for drive 3.

As an example, on the upper side of the upper mass an infrared eye 20 can be situated with which infrared signals can be received from transmit unit 17 in a known manner.

In remote control operation according to FIG. 3, all the control signals are transmitted by transmit unit 17 by remote control. The operator does not touch the vibrating plate itself, but rather can be situated several meters away from it. Of course, the vibrating plate should be steerable, i.e., should be equipped with a vibration exciter that enables steerability through the production of a yaw moment about the vertical axis of the vibrating plate.

Because in remote control operation drawbar 15 does not have a function and cannot be reached by the operator, it is provided according to the present invention that drawbar boom 16 is either folded up into an idle position or is shortened in length. For this purpose, drawbar boom 16 can be fashioned in the manner of a telescoping rod. Of course, a specific embodiment is also possible in which drawbar boom 16 can be both folded up and shortened, in order to reduce its size in such a way that during remote control operation it does not present an obstacle, while in drawbar operation it can be folded down and lengthened if necessary.

For various soil compacting jobs, e.g. precise edge compacting at a curb, it is often desirable for the operator not to operate the vibrating plate exclusively via remote control, but rather to additionally guide it manually through an application of his own force. For this purpose, it is advantageous for the operator to be able to stand directly on the machine, and to no longer have to operate the vibrating plate via transmit unit 17 as a remote control.

Correspondingly, it is possible, as is shown in FIG. 2, to place transmit unit 17 onto the end of drawbar boom 16. Of course, drawbar boom 16 should then be in an operating position having sufficient length for drawbar operation, as shown in FIG. 2.

Transmit unit 17 can be arrested on drawbar boom 16 in a mechanically robust manner with the aid of a fastening device (not shown).

As always, the operator can then use control handles 19 to give control commands to vibration exciter 2 with regard to forward and backward travel. In contrast, in the drawbar operation now being carried out steerability should not be possible, in order to exclude the possibility of an unexpected rotation of the vibrating plate and the resulting danger to the operator. Of course, however, in another specific embodiment of the present invention a rotation or steering of the vibrating plate can also be effected with the aid of control handles 19, if this is practically useful.

In drawbar operation, the control signals produced using control handles 19 are transmitted to the receiver on the vibrating plate via a suitable interface, e.g. via a direct coupling (plug contacts, similar to a laptop on a docking station), an optical interface, an infrared interface, or a short-range radio interface (Bluetooth). The part of the interface at the vibrating plate can be situated inside drawbar boom 16, but also in other areas of the upper mass, in order to protect it from external influences.

As is shown in FIGS. 2 and 3, control handles 19 are very large and robust in construction. Their design resembles that of, for example, control handles 9 according to FIG. 1, and they are therefore also suitable for receiving mechanical forces. Accordingly, the operator can pull and draw on control handles 19 in order to influence the direction of travel of the vibrating plate, and in this way to guide the vibrating plate in a more precise manner than is standardly possible with remotely controlled vibrating plates.

Control handles 19 can be made of metal, but also of high-strength plastic, so that despite their size they do not have excessive weight, which could be unpleasant for the operator in particular in remote control operation, in which transmit unit 17 has to be carried by the operator.

In order to improve the guidance possibilities for the operator, additional handles can be provided on drawbar boom 16 or on housing 18 of transmit unit 17. These handles (not shown) are then used by the operator only for stopping and guiding, but not for specifying control signals.

In this way, it is possible for the operator to switch between drawbar operation and remote control operation at any time. To do this, he need merely fasten transmit unit 17 to drawbar boom 16, or detach it therefrom.

FIG. 4 schematically shows a detail of another specific embodiment of the present invention, in which a transmit unit 21 is provided that can have smaller dimensions and a lower degree of mechanical stability than transmit unit 17 shown in FIGS. 2 and 3. Transmit unit 21 bears one or more control elements 22, which can be formed for example by levers, sliders, or keys.

In contrast to control handles 19 of transmit unit 17, control elements 22 are smaller and have lower mechanical strength. They are suitable only for inputting control signals, but not for powerful grasping by the operator in order to manually guide the travel of the vibrating plate.

So that the operator will be able to modify the direction of travel of the vibrating plate in drawbar operation and to steer the device, control handles 23 are attached to drawbar boom 16.

Control handles 23 resemble control handles 19 from FIG. 2, or control handles 9 from FIG. 1. They are fastened to the end of drawbar boom 16 in a holder (not shown in more detail) and have a robust construction, so that the operator can push and pull on them with any desired degree of force. In addition, control handles 23 are capable of movement relative to drawbar boom 16, i.e., they can in particular be pivoted about the axle by which they are held on drawbar boom 16.

On control handles 23, two fingers 24 are provided that act as an entraining device, pivoting together with the pivoting of control handles 23. Fingers 24 are situated at locations at which control elements 22 of transmit unit 21 are also situated, when transmit unit 21 is fastened to the front of drawbar boom 16. Fingers 24 simulate the fingers of the operator, and, given corresponding pivoting of control handles 23, can actuate the allocated control elements 22 on transmit unit 21, so that vibration exciter 2 is then displaced in the desired manner.

In this process, the operator grasps control handles 23 in the usual manner, e.g. in the upper area thereof. If he pivots one of control handles 23 towards the front, the corresponding control element 22 is actuated via allocated finger 24. Of course, the entraining device can also be constructed such that pulling a control handle 23 back in the direction of the operator is also communicated to an allocated control element 22.

In a variant not shown, control element 22 is formed by a lever (joystick). Here as well, the entraining device can be constructed such that the movement of control handle 23 is transferred immediately to the lever, and alters its position in the desired manner.

Control handles 23 are therefore not coupled directly to vibration exciter 2, as is the case for example in the prior art shown in FIG. 1. Control handles 23 do not act immediately to displace hydraulic valves or to activate actuating elements. Rather, their position or movement is transferred in a relatively simple manner to the operating elements (control elements) of transmit unit 21, from where the corresponding control signals are then outputted. Of course, other variants are also conceivable in which for example transmit unit 21 is not situated in front of control handles 23, but rather is situated (spatially) between them.

The holder of control handles 23 should be constructed in such a way that large forces cannot be introduced into control elements 22 or into transmit unit 21. Therefore, the holder is to be equipped with suitable stops (also spring-loaded) so that a significant part of the forces introduced by the operator is introduced directly into drawbar 16 without being guided via transmit unit 21. In addition, frictional elements can be provided in the holder so that the pivoting of control handles 23 can take place ergonomically, against a corresponding frictional resistance.

Transmit unit 21 can also be removed from drawbar boom 16 in order to change over to remote control operation. Therefore, in the lower part of the image in FIG. 4, transmit unit 21 is also shown in remote control operation, separated from the rest of the vibrating plate.

In remote control operation, control handles 23 are used only as handles, because, due to the fact that transmit unit 21 is not intermediately connected, they then cannot execute any control functions in the sense of the definition given above, and can be used by the operator only for guidance.

In drawbar operation, when transmit unit 21 is in place, the control signals are communicated from transmit unit 21 to the vibrating plate via a suitable interface, as was already described above in connection with transmit unit 17 in the vibrating plate of FIG. 2.

In addition to the already-described components, additional known assemblies can also be provided in or on transmit units 17 and 21, such as for example an energy storage unit (accumulator). Particularly advantageously, the accumulator can be charged whenever transmit unit 17, 21 is in place on drawbar boom 16. Energy can then be transmitted from the rest of the vibrating plate to the transmit unit in order to charge the accumulator. In addition, transmit units 17 and 21 can be equipped with a belt in order to improve carrying comfort, as well as with additional keys and switches, as is also the case in conventionally constricted remote control devices for vibrating plates.

The vibrating plate according to the present invention is shown only schematically in the Figures. Of course, it is easily possible for drawbar boom 16 to be pivoted further back in the direction of the operator in order to enable comfortable guiding of the vibrating plate.

The invention claimed is:

1. A vibrating plate for soil compacting, comprising:

a lower mass that has a soil contact plate and a vibration exciter device;

an upper mass that is coupled to the lower mass via a spring device and that has a drive;

a drawbar device that is connected to at least one or the upper mass and to the lower mass; and comprising a remote control device for controlling at least a forward or backward travel by controlling the vibration exciter device, the remote control device having a transmit unit that is capable of movement independently of the rest of the vibrating plate; wherein on the transmit unit, there is provided at least one control element for inputting control commands by the operator for the controlling of the vibration exciter device;

on the drawbar device, there is provided at least one control handle to be grasped by the operator for the manual guidance of the vibrating plate, and wherein the control handle is capable of movement relative to the drawbar device; wherein the transmit unit is capable of being fastened detachably to the drawbar device; and wherein when the transmit unit is fastened on the drawbar device, the control handle is coupled to the control element of the transmit unit in such a way that given a particular relative position of the control handle, an actuation of the control element of the transmit unit is effected in order to produce control commands for controlling the vibration exciter device.

2. The vibrating plate as recited in claim 1, further comprising, an entraining device for transmitting a movement of the control handle to the control element.

3. The vibrating plate as recited in claim 1, wherein the control handle is held in a holder for receiving forces introduced into the control handle by the operator, in such a way that only a small part, required for the actuation of the control element, of the forces acts on the control element and/or on the transmit unit, while a larger part of the forces is transmitted by the control handle to the drawbar device, without acting on the control element and/or on the transmit unit.

4. A vibrating plate for soil compacting, comprising:

a lower mass that has a soil contact plate and a vibration exciter device;

an upper mass that is coupled to the lower mass via a spring device and that has a drive;

a drawbar device that is connected to the upper mass and/or to the lower mass; and having a remote control device for controlling at least a forward or backward travel by controlling the vibration exciter device, having a transmit unit that is capable of being moved independently of the rest of the vibrating plate;

the transmit unit being capable of being fastened detachably to the drawbar device; wherein on the transmit unit there is provided at least one control handle that is suitable both for inputting by the operator of control commands for controlling the vibration exciter device and for being grasped by the operator for the manual guidance of the vibrating plate.

5. The vibrating plate as recited in claim 1, wherein on the transmit unit there is provided at least one control element for the inputting of control commands by the operator for controlling the vibration exciter device.

6. The vibrating plate as recited in claim 1, wherein the transmit unit is capable of being integrated detachably into the drawbar device.

7. The vibrating plate as recited in claim 1, wherein the drawbar device has a drawbar having a drawbar boom that is connected to the upper mass and/or to the lower mass, and a drawbar head connected to the drawbar boom.

8. The vibrating plate as recited in claim 7, wherein the transmit unit is capable of being fastened in a recess in the drawbar head.

9. The vibrating plate as recited in claim 7, wherein the transmit unit forms at least part of the drawbar head.

10. The vibrating plate as recited in claim 1, wherein at least one handle is provided on the drawbar device for grasping by the operator for the manual guidance of the vibrating plate.

11. The vibrating plate as recited in claim 1, wherein the vibration exciter device is fashioned such that it is capable of producing a yaw moment about a vertical axis of the vibrating plate in order to steer the vibrating plate.

12. The vibrating plate as recited in claim 11, wherein the vibration exciter device is capable of being controlled by the transmit unit in order to adjust the yaw moment when the transmit unit is separated from the rest of the vibrating plate, and wherein no yaw moment can be produced by the vibration exciter device when the transmit unit is fastened to the drawbar device.

13. The vibrating plate as recited in claim 1, wherein, in the remote control device, a control command for steering the vibrating plate is capable of being blocked when the transmit unit is fastened to the drawbar device.

14. The vibrating plate as recited in claim 1, further comprising a fastening device for fastening the transmit unit to the drawbar device in such a way that all forces exerted on the transmit unit by the operator are capable of being mechanically transmitted to the drawbar device.

15. The vibrating plate as recited in claim 1, further comprising an electrical charge device for charging an energy storage unit in the transmit unit via a supply of current from the vibrating plate when the transmit unit fastened to the drawbar device.

16. The vibrating plate as recited in claim 1, wherein, when the transmit unit is separated from the vibrating plate, the signals are capable of being transmitted from the transmit unit via at least one of a cable path, an infrared path, and a radio path to a receiver unit provided on the vibrating plate.

17. The vibrating plate as recited in claim 1, wherein, when the transmit unit is fastened to the drawbar device, the signals are capable of being transmitted from the transmit unit via at least one of a direct coupling, an optical interface, an infrared interface, and a short-range radio interface to a receiver unit provided on the vibrating plate.

18. The vibrating plate as recited in claim 17, wherein the direct coupling is fashioned as a plug contact.

19. The vibrating plate as recited in claim 1, wherein the drawbar boom is capable of being pivoted between an operating position in which the operator exerts guiding forces on the vibrating plate via the drawbar boom and a remote control position in which the operator controls the vibrating plate only via the transmit unit separated from the vibrating plate, and/or that the length of the drawbar boom is capable of being altered between the operating position and the remote control position.

* * * * *